US005532805A

United States Patent [19]

Landa

[11] Patent Number: 5,532,805

[45] Date of Patent: Jul. 2, 1996

[54] METHOD AND APPARATUS FOR DIRECT PRINTING OF IMAGES

[75] Inventor: Benzion Landa, Edmonton, Canada

[73] Assignee: Indigo N.V., Netherlands

[21] Appl. No.: 204,392

[22] PCT Filed: Sep. 20, 1991

[86] PCT No.: PCT/NL91/00181

§ 371 Date: Aug. 2, 1994

§ 102(e) Date: Aug. 2, 1994

[87] PCT Pub. No.: WO93/06532

PCT Pub. Date: Jan. 4, 1993

[51] Int. Cl.[6] ..... G03G 15/10

[52] U.S. Cl. ..... 355/256; 118/659

[58] Field of Search ..... 355/210, 245, 355/256, 257, 258, 261, 262, 265, 326 R, 327; 118/659, 660, 662; 347/55

[56] References Cited

U.S. PATENT DOCUMENTS

| | | | |
|---|---|---|---|
| 3,623,122 | 11/1971 | Fotland . | |
| 4,014,693 | 3/1977 | Clark . | |
| 4,123,762 | 10/1978 | Tomita et al. | 355/262 X |
| 4,491,855 | 1/1985 | Fujii et al. | 347/55 |
| 4,504,138 | 3/1985 | Kuehnle et al. . | |
| 4,568,955 | 2/1986 | Hosoya et al. | 347/55 |
| 4,684,238 | 8/1987 | Till et al. . | |
| 4,794,651 | 12/1988 | Landa et al. . | |
| 4,974,027 | 11/1990 | Landa et al. . | |
| 5,036,341 | 7/1991 | Larsson | 347/55 |
| 5,040,004 | 8/1991 | Schmidlin et al. | 347/55 |
| 5,070,369 | 12/1991 | Mahoney et al. | 355/327 X |
| 5,103,261 | 4/1992 | Matsuo et al. | 355/210 |
| 5,208,637 | 5/1993 | Landa | 355/256 |

FOREIGN PATENT DOCUMENTS

| | | |
|---|---|---|
| 90/04216 | 4/1990 | WIPO . |

*Primary Examiner*—Sandra L. Brase
*Attorney, Agent, or Firm*—Greenblum & Bernstein

[57] ABSTRACT

Method for forming images on a member including supplying a layer of liquid toner concentrate comprising charged toner particles and carrier liquid to a space between a first, moving member and a second, stationary member closely spaced therefrom; and selectively applying an electric field between the first and second members and transverse to the direction of motion of the moving member across selected segments of the layer of material, whereby certain segments of the layer adhere to the moving member in image configuration thereon for a first value of the electric field and other segments of the layer adhere to the second member for a second value of the electric field.

47 Claims, 5 Drawing Sheets

METHOD AND APPARATUS FOR DIRECT PRINTING OF IMAGES

FIELD OF THE INVENTION

The present invention relates generally to methods and apparatus for printing of images and more particularly to a method for direct printing of images without plates or the formation of an electrostatic latent image.

BACKGROUND OF THE INVENTION

Imaging apparatus, such as laser printers, typically comprise complex electrophotographic apparatus which are utilized to form an initial electrostatic latent image of the image which is to be printed. The electrostatic latent image is then developed by means of a liquid or powder toner, and the developed image is transferred either directly or indirectly to a final substrate.

U.S. Pat. No. 4,014,693 to Clark describes a method for forming a colored liquid deposit in image configuration on a surface without forming an initial electrostatic latent image. The method utilizes liquids which are electroviscous, i.e. whose viscosity changes as a function of the application of an electric field across them. In the Clark patent, images are deposited on a substrate by selectively applying specific voltages across such electroviscous liquids, such that at one voltage the liquid jells while at another voltage the liquid flows.

U.S. Pat. No. 4,504,138 describes a method of developing a latent imaging which includes applying a thin viscous layer of toner particles onto the circumferential surface of a rotating roller and bringing the layer so formed to a rotating photoconductive drum having a latent electrostatic image formed thereon. Transfer of portions of the toner layer then occurs as a function of the various voltages on the image and background portions of the latent image.

U.S. Pat. No. 3,623,122 describes a system in which a moving probe or a series of stationary probes are arranged to form a liquid toner image on a substrate. The liquid developer used in the apparatus has a solids concentration of 0.5% and apparently prints using electrophoretic deposition of toner particles on the substrate.

SUMMARY OF THE INVENTION

The present invention provides a new and improved method for printing images directly on a substrate without need for the prior formation of an electrostatic latent image, and without need for using electroviscous fluids. Because of the simplicity and economy of the method of the present invention, it is possible to design and construct imaging apparatus which is relatively uncomplicated, thus making them simpler and cheaper to manufacture and operate.

In general, the present invention is based on the discovery that a thin layer of highly viscous charged liquid toner concentrate can be made to "stick" to a surface in the presence of an electric field. Thus, if in a imaging region, a thin layer of such concentrate is placed between a moving surface, such as a roller and a fixed member, such as a blade, then the application of an electric field in one direction will cause the toner concentrate to be drawn toward the moving member and to leave the region with the moving member. An electric field in the opposite direction will cause the concentrate to be drawn to the fixed member which then acts as a brake for stopping the concentrate from leaving the region. If selective electric fields are set up over the region, then an image is formed.

There is therefore provided in accordance with a preferred embodiment of the present invention a method for forming images on a member including the steps of:

supplying a layer of preferably non-electroviscous liquid toner concentrate comprising charged toner particles and carrier liquid and preferably having a high cohesiveness and viscosity to a space between a first, moving member and a second, stationary member closely spaced therefrom; and selectively applying an electric field between the first and second members and transverse to the direction of motion of the moving member across selected segments of the layer of liquid toner, whereby certain segments of the layer adhere to the moving member in image configuration thereon for a first value of the electric field and other segments of the layer adhere to the stationary member for a second value of the electric field.

Preferably the method includes the step of transferring the image from the moving member to an image accumulation member by means of electrically aided transfer. In a preferred embodiment of the invention the method also includes the step of transferring the image from the third member to a final substrate.

There is further provided, in accordance with a preferred embodiment of the invention, a method for forming multicolor images on a substrate including;

maintaining a moving image accumulation surface at a first electrical potential;

supplying a layer of preferably non-electroviscous liquid toner concentrate of the respective single color to the space between each of a series of first, moving members, a portion of which engages the accumulation surface at a transfer region, and each of a series of associated second, stationary members, each said liquid toner concentrate comprising charged toner particles of a given polarity and carrier liquid and preferably having a high cohesiveness and viscosity;

selectively applying an electric field between the respective first and second members transverse to the direction of motion of the first moving member across selected segments of the layer of liquid toner, whereby certain segments of the layer adhere to the moving member in image configuration thereon for a first value of the electric field and other segments of the layer adhere to the second member for a second value of the electric field; and maintaining a potential difference between the first moving member and the image accumulation member operative to transfer toner concentrate from the first member to the image accumulating member while preventing transfer of toner from the image accumulation member to the first moving member.

In a preferred embodiment of the invention the image accumulation member is the final substrate.

The second member is preferably fixedly mounted with respect to the moving member and the space between them is a fixed space. Alternatively, the second member is resiliently urged against the surface of the moving member and the space between is formed as a result of hydrodynamic forces.

In a preferred embodiment of the invention the second member has an array of electrodes at its surface facing the moving member, preferably a plurality of electrodes spaced along the dimension of the second member transverse to the direction of motion of the first member in their region of propinquity. In a preferred embodiment of the invention feed-in lines to the electrodes are at the surface of the second member.

In preferred embodiments of the invention the surface of the moving member and the second member facing the moving member are coated with a material having a high coefficient of friction.

In a preferred embodiment of the invention the concentration of toner particles to carrier liquid is between 15 and 25 percent. Preferably, the toner particles are formed with fibrous extensions.

There is further provided, in accordance with a preferred embodiment of the invention, apparatus for forming multicolor images on a substrate including:

a moving image accumulation surface maintained at a first electrical potential;

a plurality of individual color image forming apparatus each of which is operative for forming a single color image on the moving accumulation surface, each said forming apparatus including:

a first, moving member, maintained at a second electrical potential, a portion of which engages the accumulation surface at a transfer region;

a second member closely spaced from the first member;

supply apparatus for supplying a layer of liquid toner concentrate of the respective single color to the space between the first moving member and the second member, the liquid toner concentrate comprising charged toner particles of a given polarity and carrier liquid;

field applying apparatus for selectively applying an electric field between the first and second members transverse to the direction of motion of the first moving member across selected segments of the layer of liquid toner, whereby certain segments of the layer are attracted to and adhere to the moving member in image configuration thereon for a first value of the electric field and other segments of the layer are attracted to and adhere to the second member for a second value of the electric field, wherein the potential difference formed between the first moving member and the image accumulation member by the first and second potentials is operative to transfer toner concentrate from the first member to the image accumulating member while preventing transfer of toner from the image accumulation member to the first moving member.

There is further provided in accordance with a preferred embodiment of the invention, apparatus for forming images on a substrate including:

image forming apparatus including:

a member movable in a first direction;

a stationary member closely spaced from the movable member;

supply apparatus for supplying a layer of liquid toner concentrate of a given color to the space between the movable member and the stationary member, the liquid toner concentrate comprising charged toner particles of a given polarity and carrier liquid; and field applying apparatus for selectively applying an electric field between the first and second members transverse to the direction of motion of the movable member across selected segments of the layer of liquid toner, whereby certain segments of the layer are attracted to and adhere to the movable member in image configuration thereon for a first value of the electric field and other segments of the layer are attracted to and adhere to the stationary member for a second value of the electric field thereby to form an image on the movable member; and transfer apparatus for transferring the thus formed image to a final substrate.

BRIEF DESCRIPTION OF THE DRAWINGS

The present invention will be better understood and appreciated from the following detailed description, taken in conjunction with the drawings in which.

DETAILED DESCRIPTION OF PREFERRED EMBODIMENTS

Figure 1:
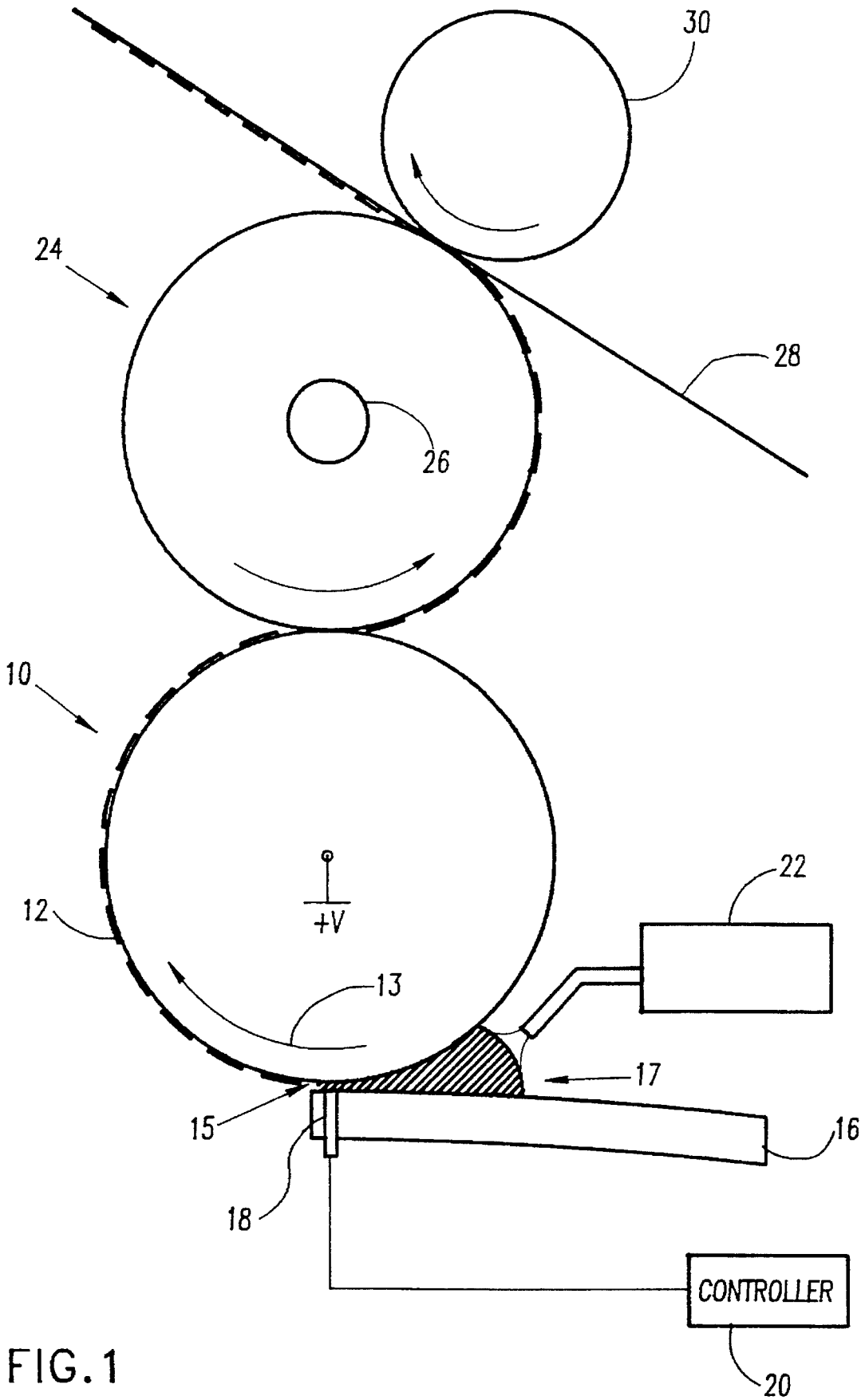
FIG. 1 is a schematic representation of imaging apparatus constructed and operative in accordance with a preferred embodiment of the present invention.

Reference is now made to FIG. 1 which shows imaging apparatus for forming liquid toner images, constructed and operative in accordance with a preferred embodiment of the present invention. The apparatus of FIG. 1 includes a drum 10 having a surface 12 composed of a non-corrosive metallic material or any other suitable electrically conducting material. Surface 12 may be coated with a thin coating having a coefficient of friction with concentrated liquid toner which is higher than that of surface 12 itself, such as a smooth coating of polyurethane material, which may be non-conducting. When the apparatus is in operation, drum 10 rotates in the direction indicated by arrow 13.

Mounted adjacent to surface 12 of drum 10 and extending along the width of drum 10 is a board 16. Board 16 may be fixedly mounted with respect to drum 10, thereby defining a very small, fixed gap 15 between their respective surfaces at their closest point of propinquity.

Alternatively, the edge of board 16 may be resiliently urged against surface 12 along the width of drum 10 either by the board being resilient as shown in FIG. 1 or by the surface of drum 10 being resilient. In such event, as described below, hydrodynamic forces are operative to form a small gap between the surfaces of drum 10 and board 16 when the apparatus is in operation. Board 16 has a closely spaced array of individually controllable electrodes 18 at its surface facing the width of drum 10, and the surface of the board facing drum 10 may be coated with a high-friction non-conducting material which may be similar to the coating on surface 12. Electrodes 18 on board 16 are connected to a controller 20 which is operative to selectively electrify any one or any set of the electrodes during the operation of the apparatus in order to form an image on surface 12 in a manner described below.

Within a space 17 between board 16 and drum 10 is a quantity of liquid toner concentrate, which is replenished by a liquid toner supply assembly 22. As drum 10 rotates, the liquid toner is pressed against surface 12 of drum 10 by the action of board 16 which functions as a squeegee blade coating surface 12 of drum 10 with a thin layer of the toner concentrate.

The toner concentrate supplied to space 17 includes a high concentration of charged toner particles within a carrier liquid. Preferably, the concentration of toner particles is between 15 and 25 percent, such that the viscosity and cohesiveness of the toner concentrate are very high. However, it is a feature of the present invention that the toner concentrate need not be electroviscous, i.e. that the viscosity of the toner not vary substantially with the application of an electric field therethrough. A preferred liquid toner for use in the present invention is a concentrated form of the toner of Example 1 of U.S. Pat. No. 4,794,651. This toner is especially suitable for use in the present invention since the particles thereof are formed with fibrous extensions, and therefore exhibits high cohesiveness and viscosity at the preferred concentrations.

When the apparatus is activated, a particular array of electrodes 18 is electrified, thereby setting up a multiplicity of electric fields across the layer of toner concentrate located in gap 15. Since the toner particles themselves bear an electric charge, the toner concentrate will be selectively drawn toward either surface 12 of drum 10 or the surface of board 16, depending upon the direction of the electric field at each electrode. Frictional forces between the toner concentrate and the surface to which the toner is drawn will increase the apparent adhesion of the toner to that surface over the adhesion of the toner concentrate to the opposite surface. It has been found by the inventors that due to the high viscosity and cohesiveness of the liquid concentrate, it is the entire layer of toner concentrate facing each individual electrode which adheres to one or other of the surfaces, and no lateral splitting of the layer occurs. However, since the layer of toner concentrate facing the electrodes is thin, and since surface 12 of drum 10 is rotating, the shear forces between adjacent "columns" of toner concentrate drawn to opposite surfaces are sufficient to cause a clean separation between them.

Furthermore, it is believed that the electric field changes the concentration profile of the thin layer of toner slightly and that a very thin layer of carrier liquid is formed at the interface between the layer and the unselected surface. The very thin layer of liquid results in a low friction force at the unselected surface and further aids in the writing process.

Thus, when the direction of the electric field causes the toner layer to be drawn towards surface 12 of drum 10, the layer will adhere to surface 12 and be fed from gap 15 as drum 10 rotates. On the other hand, when the direction of the electric field causes the toner layer to be drawn to the surface of board 16, the layer will "adhere" to board 16 and not be fed out of gap 15 by the rotational motion of drum 10. It will be readily seen that by selectively electrifying a given array of electrodes and by determining the timing and duration of their electrification, controller 20 causes a specific toner image to be selectively "extruded" from gap 15 and carried on surface 12 of drum 10 as it rotates in the direction of arrow 13.

The required voltages on drum 10 and on electrodes 18 depend on the spacing between board 16 and drum 10, the viscosity and cohesiveness of the toner concentrate (which in turn are dependent on the toner type and concentration), its charge and on the coefficients of friction of surface 12 and the surface of board 16 with the toner concentrate. In general, potential differences of 200–800 volts between electrodes 18 and drum 10 are sufficient.

The image which is formed by the selective electrification of the electrodes is preferably provided to controller 20 in the form of a bit-map image. Alternatively, controller 20 may receive a continuous tone image and include the electronics necessary to form a bit-map image from the continuous tone image.

In accordance with a preferred embodiment of the invention, there is provided downstream of board 16 an intermediate transfer member 24 which may be a drum or belt and which is in operative engagement with surface bearing the toner image. Intermediate transfer member 24 preferably has a surface comprising a resilient slightly conductive polymeric material.

Intermediate transfer member 24 rotates in a direction opposite that of drum 10, as shown by arrow 27, such that there is substantially zero relative motion between their respective surfaces where they contact. Intermediate transfer member 24 is preferably charged to an electric potential such that the difference in potential of member 24 and drum 10 is sufficient to cause transfer of the charged toner image to member 24 by electrophoretic transfer as is well known in the art.

Various types of intermediate transfer members are known and are described, for example in U.S. Pat. No. 4,684,238, PCT Publication WO 90/04216 and U.S. Pat. No. 4,974,027, the disclosures of all of which are incorporated herein by reference.

After the toner image has been transferred from surface 12 to intermediate transfer member 24 as described above, it is transferred again in a second transfer procedure from intermediate transfer member 24 to a final substrate 28, such as a sheet of paper or a web. The second transfer occurs as a result of the engagement of the surface of intermediate transfer member 24 with the substrate at the nip formed with the surface of an impression roller 30.

Member 24 is preferably heated by heater 26 so that at the point of transfer, the image is, preferably, at least partially fused and fixed upon the substrate as a result of the application of heat and pressure at the nip. Alternatively or additionally, substrate 28 and or impression roller 30 may be heated to aid second transfer.

In accordance with an alternative embodiment of the invention, the toner image is transferred directly from surface 12 to the final substrate, without being first transferred to an intermediate transfer member.

Figure 2:
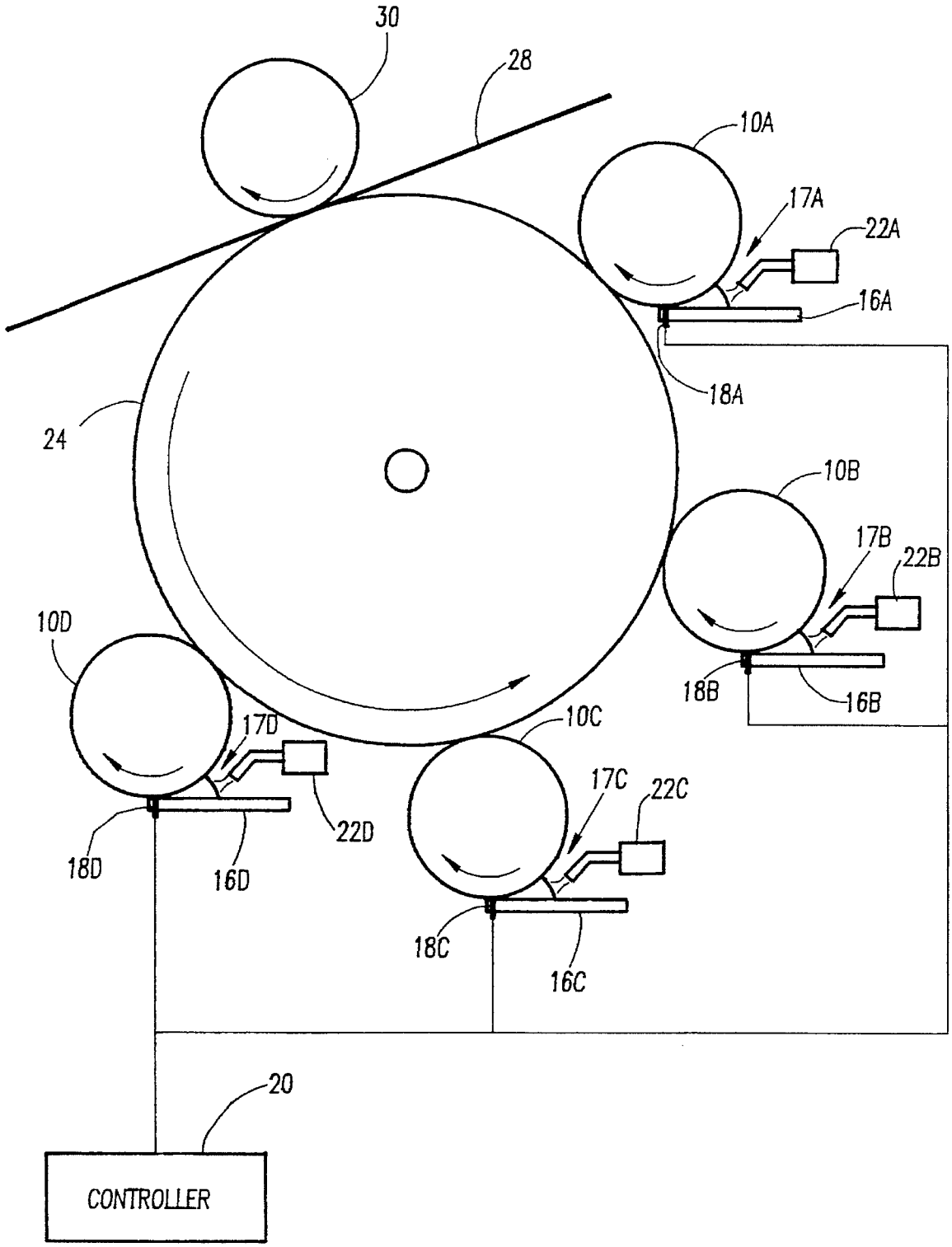
FIG. 2 is a schematic representation of multi-color imaging apparatus constructed and operative in accordance with a preferred embodiment of the present invention.

Reference is now made to FIG. 2 which shows multicolor printing apparatus in accordance with a preferred embodiment of the present invention. The apparatus of FIG. 2 is similar to that of FIG. 1 except that there are four drums 10A, 10B, 10C and 10D in operative engagement with intermediate transfer member 24, rather than the single drum 10 of FIG. 1. Mounted with respect to the surface of each of the four drums is a board (referenced 16A, 16B, 16C and 16D respectively) similar to board 16 of FIG. 1. Each of the boards has at its surface an array of electrodes (referenced 18A, 18B, 18C and 18D respectively) similar to electrodes 18 of FIG. 1, and each defines a space (17A, 17B, 17C and 17D respectively) between its surface and the surface of its associated drum. The electrodes on the boards are all connected to controller 20. In this embodiment, a different color of liquid toner concentrate, one for each of the process colors, is supplied to each of spaces 17A, 17B, 17C and 17D. Controller 22 activates the electrodes mounted at the surface of each of the boards so as to cause deposition on the corresponding drum, in the manner described above with reference to FIG. 1, of a Specific single color separation of the desired image. Each of the single color toner images is then transferred in turn to intermediate transfer member 24 and then to the final substrate.

Each of drums 10 A–D and member 24 are electrified to appropriate voltages so as to aid transfer from each of drums 10A–D to member 24 and to avoid unwanted contamination between different colors caused by backtransfer (prior to the transfer of the image to the final substrate) of the color image from intermediate transfer member 24 to the surface of a drum of a different color. A few hundred volts of potential difference between the drums and the intermediate transfer member is generally sufficient.

Figure 3A:
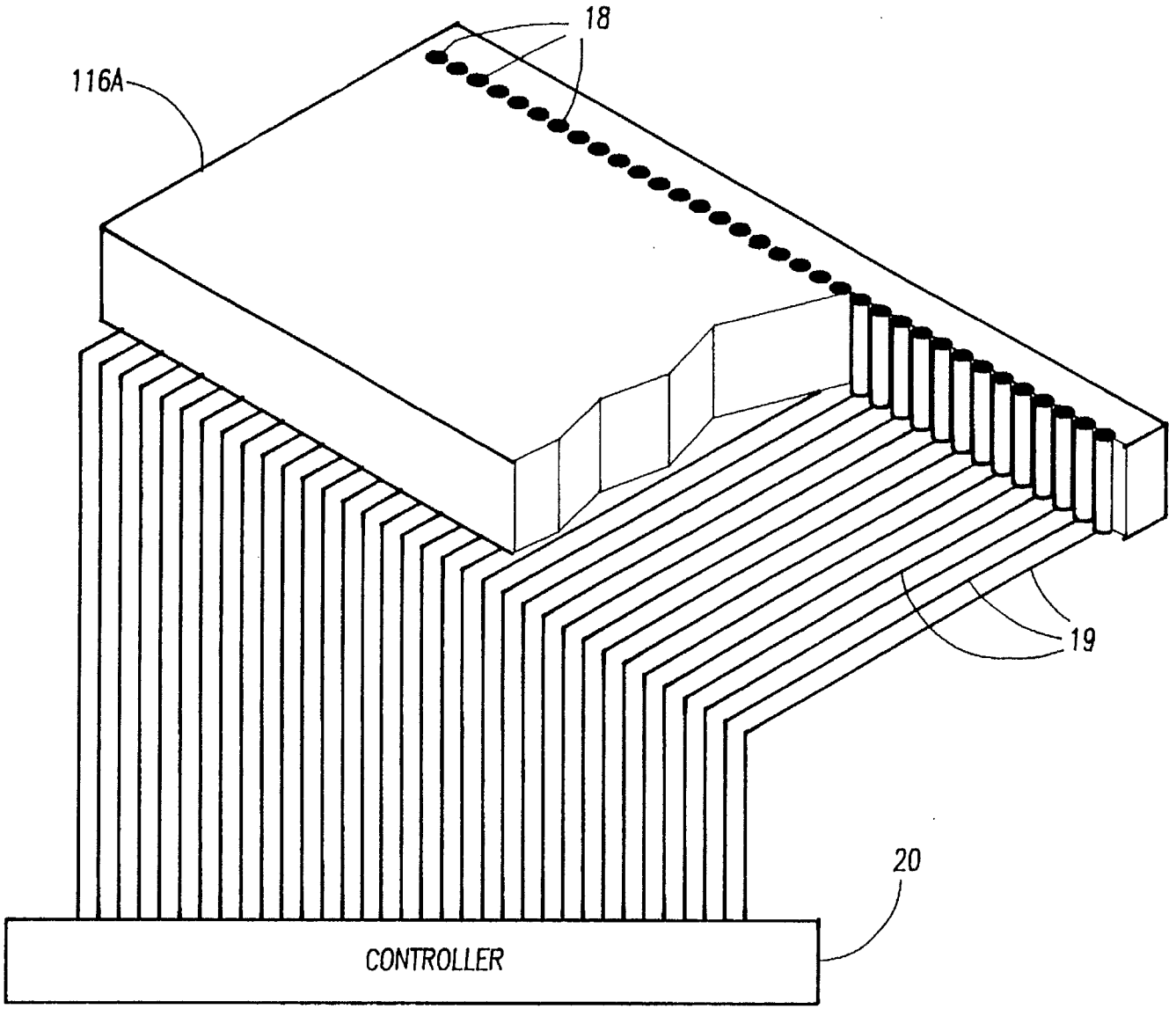
FIG. 3A is a more detailed perspective view of one of the elements shown the embodiments of FIGS. 1 and 2.
Figure 3B:
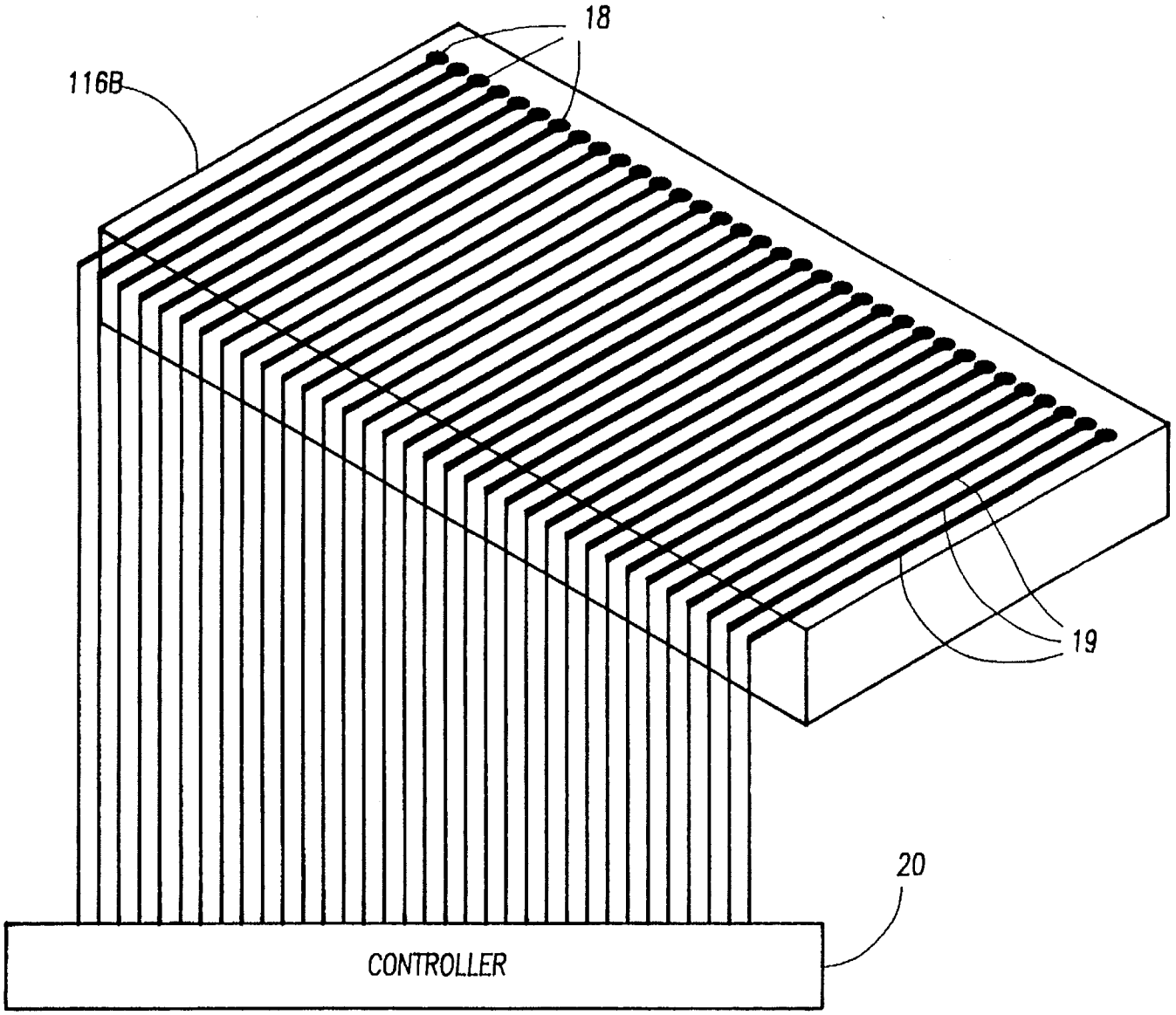
FIGS. 3B and 3C show alternative arrangements of the element of FIG. 3A.
Figure 3C:
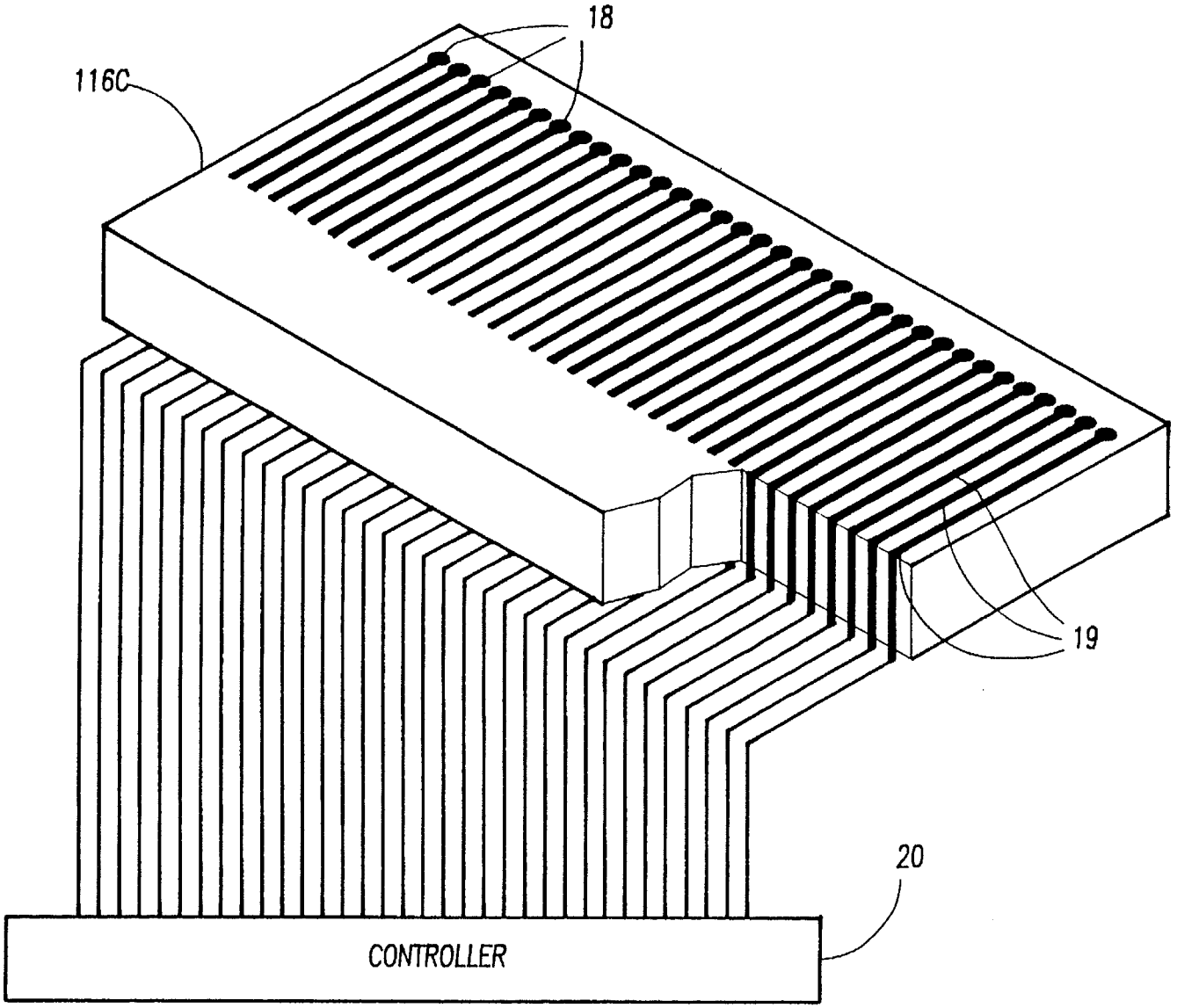

Reference is now made to FIGS. 3A, 3B and 3C which show in greater detail three different configurations of the structure of board 16, in accordance with preferred embodiments of the invention. In FIG. 3A, only electrodes 18 are at the surface of the board. Feed-in lines 19 are inserted through the board and connect the electrodes to controller 22 along the underside of the board. In FIG. 3B, the feed-in lines, like the electrodes themselves, are located at the surface of board 16 facing drum 10, extending along the full width of board 16. FIG. 3C represents a configuration which is a combination of that of FIG. 3A and FIG. 3B. In this configuration, the feed-in lines extend along the surface of board 16 for part of the width of the board and then are drawn through the board to its underside, and from there to the controller. The inventors believe that the configurations represented in FIGS. 3B and 3C provide an advantage over the configuration of FIG. 3A, in enabling the generation of electric fields across the toner concentrate located between board 16 and surface 12 over the length of the feed-in lines at the surface. As a result of these electric fields, both the flow of toner concentrate within space 17 and the forces operating upon the toner concentrate within space 17 (electrical and frictional) are distributed over a longer length and are more effective.

In a further preferred embodiment of board 16, a portion of the length of the feed-in lines (not including the electrodes) is covered with a non-conducting layer. A conducting layer is placed over the non-conducting layer and is preferably grounded electrically to electrically isolate the region between the conducting layer and the drum from the effects of voltages on the feed-in lines.

It will be appreciated by persons skilled in the art that the present invention is not limited by what has been particularly shown and described hereinabove. Rather, the scope of the present invention is defined only by the claims which follow:

I claim:

1. A method of forming images on a member comprising:

supplying a layer of material comprising charged toner particles and carrier liquid to a space between a first, moving member having a direction of motion and a second, stationary member closely spaced therefrom; and selectively applying an electric field between the first and second members and transverse to the direction of motion of the moving member across selected segments of the layer of material, causing certain segments of the layer to adhere to the moving member in image configuration thereon for a first value of the electric field and other segments of the layer to adhere to the second member for a second value of the electric field.

2. A method according to claim 1 and further comprising transferring the image from the moving member to an image accumulation member by means of electrically aided transfer.

3. A method according to claim 2 and comprising transferring the image from the image accumulation member to a final substrate.

4. A method according to claim 2 wherein transferring the image to a moving accumulation surface comprises transferring the image to a final substrate.

5. A method according to claim 2 wherein the surface of the moving member is coated with a material having a high coefficient of friction.

6. A method according to claim 2 wherein the surface of the second member facing the moving member is coated with a material having a high coefficient of friction at least in the region of propinquity of the first and second members.

7. A method according to claim 2 wherein supplying a layer of material comprises supplying a liquid toner concentrate having a high cohesiveness and viscosity.

8. A method according claim 7 wherein supplying a liquid toner concentrate comprises supplying a liquid toner concentrate having a concentration of toner particles to carrier liquid of between 15 and 25 percent.

9. A method according to claim 2 wherein supplying a layer of material comprises supplying liquid toner which is substantially non-electroviscous.

10. A method according to claim 2 and further comprising the providing the first moving member with a resilient surface.

11. A method according to claim 1 wherein the second member is fixedly mounted with respect to the moving member and the space between them is a fixed space.

12. A method according to claim 1 wherein the second member is resiliently urged against the surface of the moving member and the space between is formed as a result of hydrodynamic forces.

13. A method according claim 1 wherein selectively applying an electric field between the first and second members comprises providing the second member with an array of electrodes at its surface facing the moving member in their region of propinquity.

14. A method according to claim 13 wherein providing the second member with an array of electrodes comprises providing the second member with a plurality of electrodes spaced along the dimension of the second member transverse to the direction of motion of the first member.

15. A method according to claim 13 wherein providing the second member with an array of electrodes comprises providing feed-in lines to the electrodes at the surface of the second member.

16. A method according to claim 1 wherein the surface of the moving member is coated with a material having a high coefficient of friction.

17. A method according to claim 1 wherein the surface of the second member-facing the moving member is coated with a material having a high coefficient of friction at least in the region of propinquity of the first and second members.

18. A method according to claim 1 wherein supplying a layer of material comprises supplying a liquid toner concentrate having a high cohesiveness and viscosity.

19. A method according claim 18 wherein supplying a liquid toner concentrate Comprises supplying a liquid toner concentrate having a concentration of toner particles to carrier liquid of between 15 and 25 percent.

20. A method according to claim 1 wherein the toner particles are formed with fibrous extensions.

21. A method according to claim 1 wherein supplying a layer of material comprises supplying liquid toner which is substantially non-electroviscous.

22. A method according to claim 1 and further comprising providing the first moving member with a resilient surface.

23. A method for forming multi-color images on a substrate comprising:

maintaining a moving image accumulation surface at a first electrical potential;

supplying a layer of material of a respective single color to a space between each of a series of first, moving members having a first direction of motion, a portion of each of which engages the accumulation surface at a transfer region, and each of a series of associated, respective, second, stationary members, each said material comprising charged toner particles of a given polarity and carrier liquid;

selectively applying an electric field between the respective first and second members transverse to the direction of motion of the first moving member across selected segments of the layer of material, causing certain segments of the layer to adhere to the moving member in image configuration thereon for a first value of the electric field and other segments of the layer to adhere to the second member for a second value of the electric field; and maintaining a potential difference between the first moving member and the image accumulation surface operative to transfer material from the first member to the image accumulation surface while preventing transfer of material from the image accumulation surface to the moving member.

24. A method according to claim 23 and comprising transferring the image from the image accumulation surface to a final substrate.

25. A method according to claim 23 wherein maintaining a moving accumulation surface comprises maintaining the moving image accumulation surface which is a final substrate at a first electrical potential.

26. A method according to claim 23 wherein the second member is fixedly mounted with respect to the moving member and the space between them is a fixed space.

27. A method according to claim 23 wherein the second member is resiliently urged against the surface of the moving member and the space between is formed as a result of hydrodynamic forces.

28. A method according claim 23 wherein selectively applying an electric field between the first and second members comprises providing the second member with an array of electrodes at its surface facing the moving member in their region of propinquity.

29. A method according to claim 28 wherein providing the second member with an array of electrodes comprises providing the second member with a plurality of electrodes spaced along the dimension of the second member transverse to the direction of motion of the first member.

30. A method according to claim 28 wherein providing the second member with an array of electrodes comprises providing feed-in lines to the electrodes at the surface of the second member.

31. A method according to claim 23 wherein the surface of the moving member is coated with a material having a high coefficient of friction.

32. A method according to claim 23 wherein the surface of the second member facing the moving member is coated with a material having a high coefficient of friction at least in the region of propinquity of the first and second members.

33. A method according to claim 23 wherein supplying a layer of material comprises supplying a liquid toner concentrate having a high cohesiveness and viscosity.

34. A method according claim 33 wherein supplying a liquid toner concentrate comprises supplying a liquid toner concentrate having a concentration of toner particles to carrier liquid of between 15 and 25 percent.

35. A method according to claim 23 wherein the toner particles are formed with fibrous extensions.

36. A method according to claim 23 wherein supplying a layer of material comprises supplying liquid toner which is substantially non-electroviscous.

37. A method according to claim 23 and further comprising providing the first moving member with a resilient surface.

38. Apparatus for forming images on a final substrate comprising:

a member movable in a given direction;

a stationary member closely spaced from the movable member;

a source of material of a given color comprising charged toner particles of a given polarity and carrier liquid, operative to supply a layer of material to the space between the movable member and the stationary member; and control apparatus operative to selectively apply an electric field between the movable and stationary members transverse to the direction of motion of the movable member across selected segments of the material thereat, causing certain segments of the layer are attracted to and adhere to the movable member in image configuration thereon for a first value of the electric field and form an image thereon and other segments of the layer are attracted to and adhere to the stationary member for a second value of the electric field; and an image transfer region at which the thus formed image is transferred to the final substrate.

39. Apparatus according to claim 38 wherein the liquid toner concentrate is substantially non-electroviscous.

40. Apparatus according to claim 39 wherein the moving member has a resilient surface.

41. Apparatus according to claim 38 wherein the moving member has a resilient surface.

42. Apparatus according to claim 38 wherein the material is a liquid toner concentrate.

43. Apparatus for forming multi-color images on a final substrate comprising:

a moving image accumulation surface maintained at a first electrical potential;

a plurality of individual color printing engines each of which is operative for forming a single color image on the moving accumulation surface, each Of said engines comprising:

a first, moving member movable in a given direction, maintained at a second electrical potential, a portion of which engages the accumulation surface at a transfer region;

a second member closely spaced from the first member;

a plurality of sources of single color material, each of the materials comprising charged toner particles of a given polarity and carrier liquid operative to supply a layer of material of the respective single color to the space between the movable member and the second member;

control apparatus operative to selectively apply an electric field between the first and second members transverse to the direction of motion of the first moving member across selected segments of the material thereat, causing certain segments of the layer to be attracted to and adhere to the moving member in image configuration thereon for a first value of the electric field and form an image thereon and other segments of the layer to be attracted to and adhere to the second member for a second value of the electric field;

wherein the potential difference between the first moving member and the image accumulation surface by the first and second potentials is operative to transfer material from the first member to the image accumulation surface while preventing transfer of material from the image accumulation surface to the first moving member; and an image transfer region at which material is transferred from the image accumulation surface to the final substrate.

44. Apparatus according to claim 43 wherein the liquid toner concentrate is substantially non-electroviscous.

45. Apparatus according to claim 44 wherein the moving member has a resilient surface.

46. Apparatus according to claim 43 wherein the moving member has a resilient surface.

47. Apparatus according to claim 43 wherein the material is a liquid tuner concentrate.

* * * * *